US010435213B2

(12) United States Patent
Schuttler et al.

(10) Patent No.: US 10,435,213 B2
(45) Date of Patent: Oct. 8, 2019

(54) FASTENER WITH SUPPORT FEATURE FOR PAWL COMPONENT

(71) Applicant: AVERY DENNISON CORPORATION, Glendale, CA (US)

(72) Inventors: David L. Schuttler, Townsend, MA (US); Daniel M. Gilbertson, Millbury, MA (US); Charles J. Burout, III, Bedford, NH (US)

(73) Assignee: Avery Dennison Corporation, Glendale, CA (US)

( * ) Notice: Subject to any disclaimer, the term of this patent is extended or adjusted under 35 U.S.C. 154(b) by 74 days.

(21) Appl. No.: 15/376,093

(22) Filed: Dec. 12, 2016

(65) Prior Publication Data

US 2017/0166370 A1 Jun. 15, 2017

Related U.S. Application Data

(60) Provisional application No. 62/265,603, filed on Dec. 10, 2015.

(51) Int. Cl.
*B65D 63/10* (2006.01)
*G09F 3/03* (2006.01)

(52) U.S. Cl.
CPC ..... *B65D 63/1072* (2013.01); *G09F 3/037* (2013.01); *B65D 2255/20* (2013.01)

(58) Field of Classification Search
CPC ..... B65D 2255/20; B65D 63/1072
See application file for complete search history.

(56) References Cited

U.S. PATENT DOCUMENTS 3,588,962 A * 6/1971 Feldberf ..... F16L 3/233 24/16 PB
3,908,233 A * 9/1975 Caveney ..... F16L 3/2334 24/16 PB
3,949,449 A * 4/1976 Caveney ..... B65D 63/1072 24/16 PB
3,952,373 A * 4/1976 Noorily ..... F16L 3/2332 24/16 PB
3,965,538 A * 6/1976 Caveney ..... B65D 63/1072 24/16 PB
4,003,106 A * 1/1977 Schumacher ..... B65D 63/1063 24/16 PB (Continued)

FOREIGN PATENT DOCUMENTS

EP 2104084 9/2009
WO 0079168 12/2000

OTHER PUBLICATIONS

International Search Report and Written Opinion issued in corresponding IA No. PCT/US16/66172, dated Mar. 1, 2017.

*Primary Examiner* — Victor D Batson
*Assistant Examiner* — David M Upchurch
(74) *Attorney, Agent, or Firm* — Avery Dennison Corporation

(57) ABSTRACT

A fastener assembly having a unique pawl design for the head portion of a fastener assembly. The fastener assembly may be a cable tie that includes a head portion having a pawl that includes a primary pawl tooth, at least one set of secondary pawl teeth, and a shelf support feature for pawl. The fastener assembly of the present invention prevent pawl roll out which is a failure that currently occurs with fastener assembly currently available in the market place.

13 Claims, 4 Drawing Sheets

(56) References Cited

U.S. PATENT DOCUMENTS

| | | | | |
|---|---|---|---|---|
| 4,138,770 | A * | 2/1979 | Barrette | B65D 63/1072 24/16 PB |
| 5,911,368 | A * | 6/1999 | Davignon | B65D 63/1081 24/16 PB |
| 6,751,828 | B2 * | 6/2004 | Matschiner | B65D 63/1072 24/16 PB |
| 6,807,714 | B2 * | 10/2004 | O'Young | B65D 63/1072 24/16 PB |
| 7,017,237 | B2 | 3/2006 | Magno et al. | |
| 7,676,892 | B2 * | 3/2010 | Tomory | B65D 63/1072 24/16 PB |
| 2004/0049890 | A1 * | 3/2004 | Kurmis | B65D 63/14 24/16 PB |
| 2006/0123603 | A1 * | 6/2006 | Hewes | B65D 63/1072 24/16 PB |
| 2010/0212117 | A1 * | 8/2010 | Haase | B65D 63/1027 24/16 PB |
| 2012/0272485 | A1 * | 11/2012 | Liang | B65D 63/1072 24/16 PB |

* cited by examiner

FASTENER WITH SUPPORT FEATURE FOR PAWL COMPONENT

CROSS REFERENCE TO RELATED APPLICATIONS

The present application claims priority to and the benefit of U.S. Provisional Application No. 62/265,603 filed on Dec. 10, 2015, which is incorporated herein by reference in its entirety.

FIELD OF THE INVENTION

The present invention relates generally to a fastener assembly and more specifically to a fastener assembly which includes a fastener having a head portion with an internal pawl feature that increases the overall loop tensile strength of the fastener.

BACKGROUND OF THE INVENTION

Plastic fasteners of the type commonly used for consumer goods, for example attach merchandise tags to article of commerce, such as article of clothing, and may also be used in automotive packaging and electrical applications as well. Typically, fasteners are mass-produced into one of two different forms known as fastener stock. One type of fastener stock comprises a plurality of fasteners joined together at their respective cross-bars by an orthogonally disposed runner bar. The other type of fastener stock comprises a plurality of fasteners arranged in an end-to-end alignment, the ends of successive fasteners being joined together by severable connectors so as to form a length of continuously connected fastener stock.

A common type of fastener assembly is a cable tie having a head, a strap and a tail. The head portion of a cable tie generally has a pawl portion. Another type of fastener assembly is of the type which includes an elongated flexible filament having a first cross-bar at one end and a paddle or a second-cross-bar at the opposite end.

One type of common problem with fasteners, particularly cable ties, is that under high loop tensile force, the head portion of the fastener slips. For instance, when the strap of the cable tie is inserted into the head of the cable tie and cinched around an object, such as an article of merchandise or automotive wires, the pawl of the head portion of the cable tie pivots and the ratcheting teeth on the pawl engage with teeth on the strap of the cable tie. The potentially weak aspect of the fastener, such as the cable tie, is typically in the pawl such that when the loop tensile load increases, the pawl feature of the head portion of the cable tie flexes and distorts. The main failure for fasteners currently in the marketplace is referred to as "pawl roll out" which is when the pawl rotates out of the head portion of the fastener assembly and disengages from the teeth on the strap of the fastener assembly causing the fastener to release.

Another problem with the fasteners currently available in the market place, is that increasing the loop tensile strength of a cable tie requires increasing the size of the pawl feature of the head portion of the cable tie, which, in turn, requires an increase in the cross section of the cable tie strap and the overall size of the head. This design approach requires more material usage and thus, increases the cost to manufacture the product. A still further design approach currently in use in the marketplace to increase loop tensile strength is to increase the strap tooth depth. This requires more material usage and requires the user of the cable tie to use more force when cinching the strap around an article. Therefore, user fatigue becomes an issue after many repeated uses of a fastener or plurality of fasteners having this design.

The present invention provides for a fastener assembly that allows for an increase in the overall loop tensile strength of a fastener without the need for additional material usage or compromising the application force of the cable tie and avoids a "pawl roll out" failure.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

It is an object of the present invention to provide a new fastener assembly having a novel pawl design. The fastener assembly of present invention may comprise, in one embodiment, a head portion having a pawl that includes at least one tooth for engagement purposes with a strap. The fastener assembly also includes a shelf support feature for the pawl of the assembly.

In a further exemplary embodiment of the present invention a fastener assembly is described and includes a locking head portion having a pawl with at least one tooth. At least one tooth of the pawl engages with an elongated portion of the fastener assembly. The presently described fastener assembly also includes a shelf feature within the pawl.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

Figure 1:
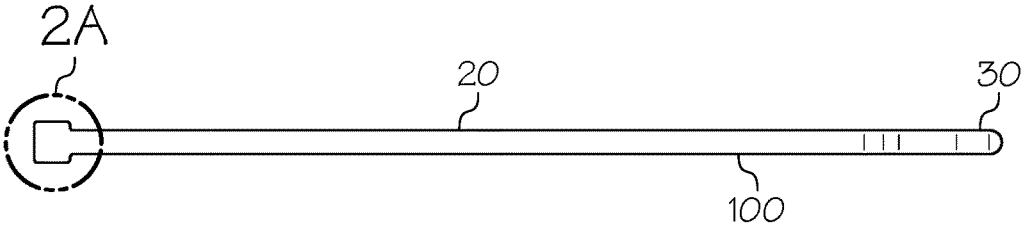
FIG. 1 illustrates a fastener assembly in accordance with the present invention.
Figure 1A:
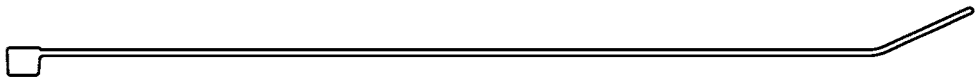
FIG. 1A illustrates an additional view of the fastener assembly in accordance with the present invention.
Figure 1B:
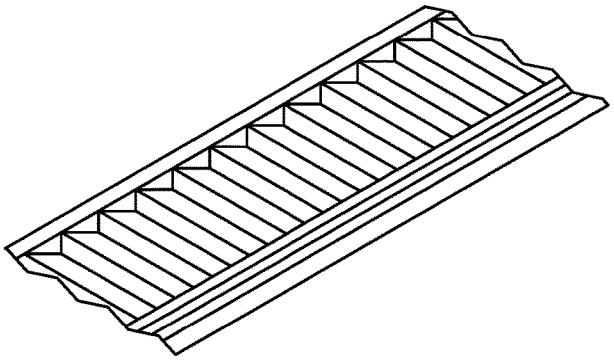
FIG. 1B illustrates a detail view of the strap portion of the present invention as illustrated in FIG. 1C.
Figure 1C:
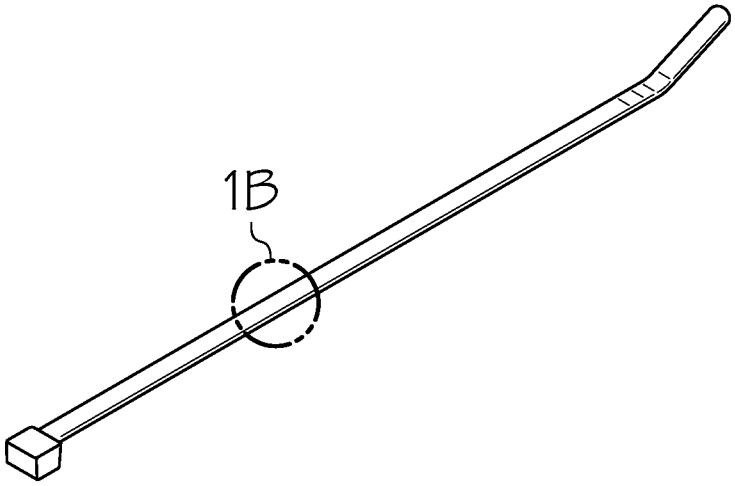
FIG. 1C illustrates an additional view of the fastener assembly in accordance with the present invention.
Figure 1D:
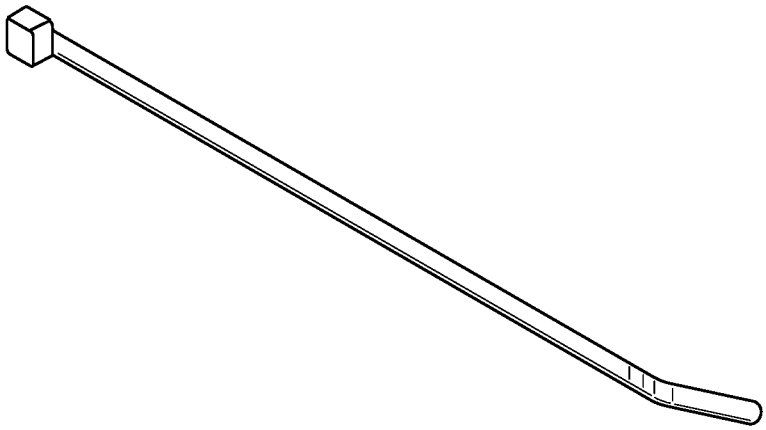
FIG. 1D illustrates an additional view of the fastener assembly in accordance with the present invention.

The apparatuses and methods disclosed in this document are described in detail by way of examples and with reference to the figures. Unless otherwise specified, like numbers in the figures indicate references to the same, similar, or corresponding elements throughout the figures. It will be appreciated that modifications to disclosed and described examples, arrangements, configurations, components, elements, apparatuses, methods, materials, etc. can be made and may be desired for a specific application. In this disclosure, any identification of specific shapes, materials, techniques, arrangements, etc. are either related to a specific example presented or are merely a general description of such a shape, material, technique, arrangement, etc. Identifications of specific details or examples are not intended to be, and should not be, construed as mandatory or limiting unless specifically designated as such. Selected examples of apparatuses and methods are hereinafter disclosed and described in detail with reference made to FIGURES.

Referring now to the drawings of the present invention, there is shown a fastener assembly, particularly a cable tie. However, the present invention contemplates that the present invention relates to any type of fastener assembly well known in the art such as a paddle fastener.

Figure 2:
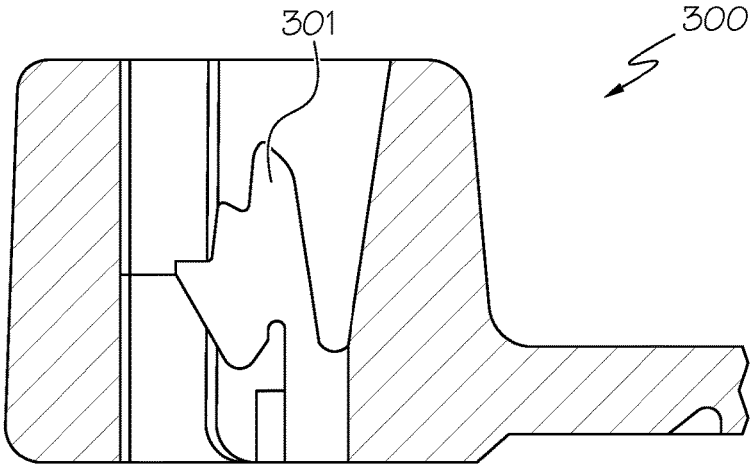
FIG. 2 illustrates the detail and section view of the head portion of the present invention as illustrated in FIG. 1.

FIG. 1 illustrates a cable tie 100 fastener assembly comprising an elongated portion 20 which can also be referred to as a strap. The fastener assembly also includes a locking head portion 10, and a tail portion 30. The elongated portion 20 of the cable tie 100 may have a non-smooth section that, in one embodiment, includes a plurality of teeth. The present invention also contemplates that the elongated portion may also include a smooth section that does not include a plurality of teeth. The head portion 300 of a standard cable tie 100 may include an internal feature known as a pawl 301 as illustrated in FIG. 2 of the present invention. The elongated portion of the cable tie 100 may include a tail 30. The elongated portion 20 has a plurality of teeth which are patterned and engage the pawl 301 of the head portion 10 of the cable tie 100 when the tail 30 of the elongated portion 20 is inserted into the head portion 10 for engagement and utilization of the fastener assembly.

Figure 4:
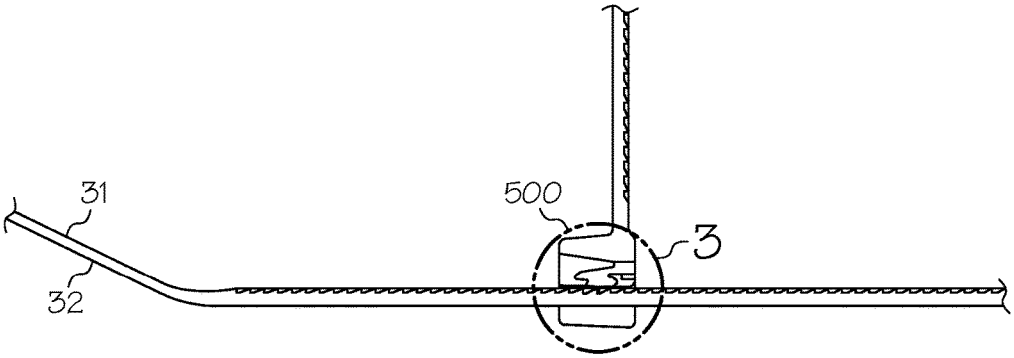
FIG. 4 illustrates the cross sectional view of the strap of the present invention passing through the head portion of the present invention as illustrated in FIG. 1.

The tail 30 of the elongated portion 20, in one embodiment, may be formed by an angled extension of the elongated portion 20. For instance, in one example, the tail 30 and the strap 20 may be at a 40 degree angle respectively. The present invention contemplates that many different angle degrees are contemplated. In one embodiment of the present invention, the tail 30 of the fastener assembly 100 tapers into a narrow tip. The elongated portion 30 of the fastener assembly may have a smooth surface and a non-smooth surface. In one embodiment, as illustrated in FIG. 4, the elongated portion may have a top 31 and bottom 32 face. The top face 31 of the elongated portion 30 may have a non smooth and/or smooth section and the bottom face 32 of the elongated portion 30 may have a non smooth and/or smooth section. FIG. 4 illustrates an elongated portion 30 passing through the head portion 500.

The elongated portion or if utilized, strap 20 can be molded and then stretched in one embodiment of the present invention. This material, upon stretching, not only reduces the volume per unit length of the strap but also provides enhanced physical properties. For example, there is increased strength in tensile and shear strength. Tensile ranges will vary depending on the type of polymer. The presently disclosed pawl with its new design aids in eliminating pawl "roll out" and loop tensile values may be raised in a range of 15% to 50%.

The material inserted into the mold, which may be advantageously accomplished by injection molding, has an enlarged channel for the flow of material, as compared with the standard ladder structure. The result is that imperfections that often hinder molding, such as cold shuts, voids and nit marks are either eliminated or significantly reduced in extent. It must be noted that because tail 30 tapers into a narrower tip of approximately 1 mm width, tail 30 can be threaded through relatively narrow openings, such as the eyelet of a shoe, or even button holes of a shirt. This construction enables the user to pair together articles which have relatively small holes.

Figure 2A:
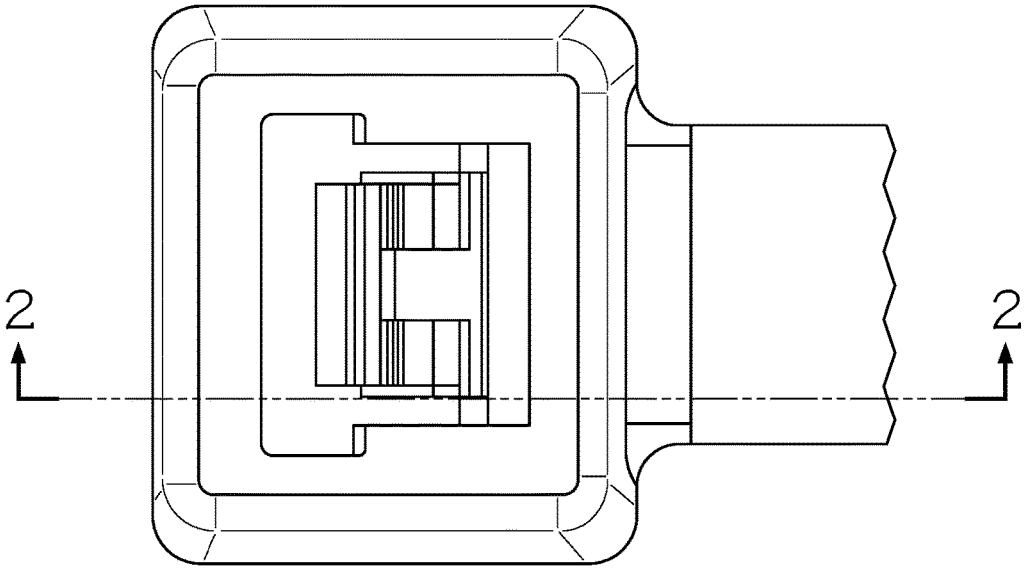
FIG. 2A further illustrates a plan view of the head portion as illustrated in FIG. 2.

The head portion 300, illustrated in FIGS. 2 and 2*a*, may be rectangular in shape and includes a bottom wall, top wall, and an elongated channel which extends through head 300 from bottom wall to top wall. The present invention contemplates that the head 300 may be any sort of geometric shape such as an oval, circle, triangle etc. Head 300 further includes a locking tang which may be either of the stationary type or the deflectable type.

Figure 3:
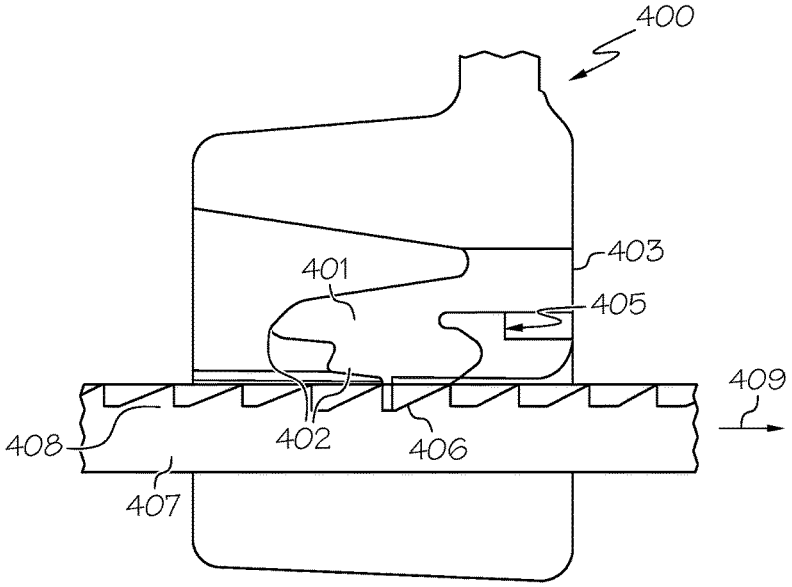
FIG. 3 illustrates a detailed cross sectional view of the interaction between strap and pawl.

In one embodiment of the present invention, illustrated in FIG. 3, the pawl 401 of the head portion 400 of a cable tie 100 includes at least one primary pawl tooth 406 and may include at least one secondary pawl tooth 402. In one embodiment of the present invention, the at least primary pawl tooth 406 engages with at least one strap tooth 408 on the elongated portion 30 of a cable tie 10.

Figure 5:
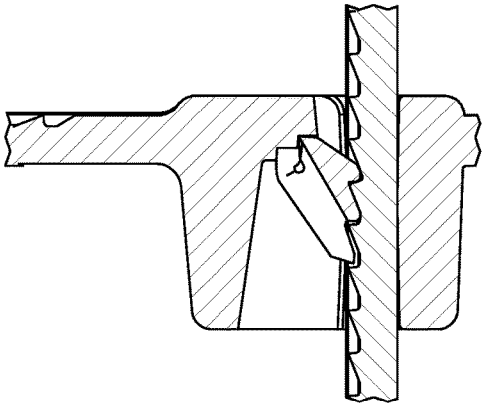
FIG. 5 illustrates a detailed cross sectional view of the interaction between strap and pawl when the pawl is deflected under tension.

In one embodiment of the present invention, as illustrated in FIG. 3, the head portion 400 may have a shelf support feature 405 for the pawl 401 of the head portion 400. This enhanced pawl 401 design relies on an additional shelf feature 405 within the head portion 400. The pawl 401 engages the strap 407 via teeth on the pawl. More specifically the pawl 401 may have a primary pawl tooth 406 and a set of secondary pawl teeth 402. The present invention contemplates that the pawl has at least one tooth, but may have any number of teeth in order to engage the strap 407 of the fastener assembly. The geometry of the teeth of the pawl 401 is designed to prevent the strap 407 from backing out of the head portion 400 when placed under tension. In the event that the pawl 401 was under a load 409, the pawl 401 rotates and locks on the shelf feature 405, preventing "pawl roll out", as illustrated in FIG. 5.

The shelf support feature 405, in one embodiment, is located below the locking mechanism created by structures 402 and 406 within the pawl 401. The shelf feature 405 extends from the pawl and it protrudes within the head 400. The shelf support feature 405 extends to between the inner walls of the head 400. The shelf support feature may be molded and constructed of material similar to the rest of the fastener, such as; a molecular reorientable type material, such as nylon, polypropylene, polyester, urethane, or the like. This material reduces the volume per unit length of the strap but also provides enhanced physical properties. A typical cable tie failure mode when applying a loop tensile load is referred to in the art as a pawl "roll out". However with this new head design, pawl "roll out" may be virtually eliminated and loop tensile values are raised 15% to 50%. The present invention is not limited in the range of loop tensile value ranges.

As strap 407 is pulled forward through head 400, as illustrated in FIG. 3, the size of the closed loop decreases. Locking features, such as tooth profiles of pawl 401 and strap 407, are designed so as to permit strap 407 to advance forward through head 400. In one embodiment, the head 400 portion has an underside on which there is a tooth profile. The present invention, also contemplates that an underside of the head portion 400 may not have a tooth profile. However, in addition to permitting strap 407 to advance forward through head 400, a locking mechanism is also designed to engage the strap teeth 408 when strap 407 is thrust in the reverse direction. Therefore, strap 407 can be advanced forward through head 400 to decrease the size of the closed loop, but strap 407 cannot be thrust in the reverse direction to increase the size of the closed loop. As a result, once strap 407 is advanced through head 400 to secure two or more items, the two or more items will remain paired together until the fastener assembly is cut.

Additionally, the head portion 400 illustrated in FIG. 3, has at least one common support 403. This support is common in many cable ties with a pawl 401 and allows the pawl to deflect, enabling the tail 30 and strap 407 to enter the head portion 400. The common support 403 also enables engagement of primary pawl tooth 406 with strap tooth 408.

It should be noted that tie 100 in FIG. 1 is not limited to having strap teeth as means for locking strap 20 within locking head 300. To the contrary, fastener 100 may utilize alternative means for lockably retaining strap 20 within head 300 such as laddered style tooth geometry.

It will thus be seen according to the present invention a highly advantageous. Fastener assembly has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

What is claimed is:

1. A fastener comprising:

a head portion having a pawl that includes a common support, a primary pawl tooth and at least one set of secondary pawl teeth;

a shelf support feature for the pawl;

an elongated portion having at least one strap tooth; and a tail portion;

wherein under a load, the pawl rotates and locks onto the shelf support feature;

the common support engages the primary pawl tooth with at least one strap tooth; and the shelf support feature extends between inner walls of the head portion.

2. The fastener of claim 1, wherein the fastener is a molded polymer cable tie.

3. The fastener of claim 1, wherein the pawl has a plurality of dynamic pivot locations.

4. The fastener of claim 1, wherein the strap is constructed in the form of a ratchet.

5. The fastener of claim 1, wherein the shelf support feature extends from below the pawl.

6. The fastener of claim 1, wherein loop tensile values are raised 15% to 50% by utilization of the pawl and shelf support feature of the head portion.

7. A fastener assembly comprising:

a locking head portion having a pawl that includes a common support and at least one tooth;

an elongated portion that includes a non-smooth section such that the at least one tooth of the pawl engages with the non-smooth section of the elongated portion; and a shelf support feature for the pawl;

wherein under a load, the pawl rotates and locks onto the shelf support feature;

the common support engages the primary pawl tooth with at least one strap tooth; and the shelf support feature extends between inner walls of the head portion.

8. The assembly of claim 7, wherein the shelf support feature is molded.

9. The assembly of claim 7, wherein the shelf support feature is made out of a molecular reorientable type material.

10. The assembly of claim 7, wherein the non-smooth section includes a plurality of teeth.

11. The assembly of claim 7, wherein at least one tooth is a primary tooth.

12. A method of utilizing the fastener assembly set forth in claim 1 comprising the steps of:

pulling the elongated portion through the head; and engaging the pawl with the elongated portion wherein the head portion is designed to engage a section of the elongated portion when the elongated portion is thrust in the reverse direction.

13. The assembly of claim 7, wherein the shelf support feature is made out of nylon, polypropylene, polyester, or urethane.

* * * * *